US006001443A

United States Patent [19]

Holden et al.

[11] Patent Number: 6,001,443

[45] Date of Patent: Dec. 14, 1999

[54] DRYER FABRIC SEAMING

[75] Inventors: David Holden; Philip Coop, both of Lancashire, United Kingdom

[73] Assignee: Scapa Group PLC, Blackburn, United Kingdom

[21] Appl. No.: 09/043,498

[22] PCT Filed: Sep. 30, 1996

[86] PCT No.: PCT/GB96/02388

§ 371 Date: Jun. 1, 1998

§ 102(e) Date: Jun. 1, 1998

[87] PCT Pub. No.: WO97/13028

PCT Pub. Date: Apr. 10, 1997

[30] Foreign Application Priority Data

Sep. 29, 1995 [GB] United Kingdom ..... 9519837

[51] Int. Cl.[6] ..... B32B 3/06

[52] U.S. Cl. ..... 428/61; 428/58; 428/100; 139/383 AA; 162/904

[58] Field of Search ..... 428/61, 58, 57, 428/99, 100, 102; 139/383 AA; 162/904

[56] References Cited

FOREIGN PATENT DOCUMENTS 0 274 244 7/1988 European Pat. Off. .
89/08740 9/1989 WIPO .

*Primary Examiner*—Alexander Thomas
*Attorney, Agent, or Firm*—Jacobson, Price, Holman & Stern, PLLC

[57] ABSTRACT

A temporary seaming aid for use in seaming a dryer fabric, comprising complementary parts (39) attached to two portions (31, 32) of a dryer fabric. The complementary parts are adapted for cooperation and enable the fabric ends which have interdigitating formations (33) thereon to engage. Engagement of the interdigitating formations allow a pintle wire (34) to be inserted therein to form a flexible joint resulting in seaming of the dryer fabric. The entire temporary seaming aid can easily be removed once the fabric ends are joined.

15 Claims, 4 Drawing Sheets

DRYER FABRIC SEAMING

This invention relates to the joining together of the two ends of a papermaking dryer fabric to form an endless belt.

Such fabrics may be from two to ten metres wide and from fifteen to over a hundred metres long and the making of a satisfactory seam quickly and easily is essential for the efficient operation of a dryer. To facilitate the formation of a seam the free ends of the web are each provided with complementary interdigitating formations, such as loops which when in engagement define a passage through which a pintle wire may be passed. In order to form this joint the ends of the web must be drawn towards each other correctly and the two rows of formations aligned accurately before the pintle wire is inserted.

It is known to use a temporary seaming aid when forming the seam so as to hold the interdigitated loops in position as the pintle wire is passed down the tunnel defined by the interdigitated loops.

One such temporary seaming aid 10 is illustrated in FIG. 1. Here small pads 11 of grip material (such as a hook or pile fastener) are secured to fabric ends 12 and straps 13 of complementary surface-grip material (such as a pile or hook fabric) are secured to straps 13. Straps 13 overlie the interdigitated Loops 14 and can be press-fitted to the pads 11 to hold the loops 14 together whilst the pintle wire 15 is threaded in. The pads 11 and straps 13 are secured to the dryer fabric with stitching. Removal of the temporary seaming aid 10 after seaming is difficult in that the many individual straps and pads must be removed separately.

Removal of the stitching may result in damage to the dryer fabric in the seam region, which in turn will adversely affect the permeability of the fabric. Also it is difficult to gain access to the seaming aids which are not at the edges of the fabric. As these fabrics are very wide an operator may need to climb onto the fabric to remove some of the seaming aids. This may damage the fabric and adversely affect its permeability. The operator may even need to climb into the paper machine itself in order to remove some of the seaming aids. This is clearly hazardous and should be avoided.

FIG. 2 illustrates a further prior art temporary seaming aid 20 which is described in detail in EP 0274244. An elongate pad 21 of grip material (such as a hook or pile fastener) is secured to one of the fabric ends 22 across the entire width of the fabric. A flap 23 of complementary surface-grip material (such as a pile or hook fastener) is secured to the other of the fabric ends and can be pressfitted to the pad 21 to hold the loops 24 together whilst the pintle wire 25 is threaded in. The flap 23 extends across the full width of the fabric. A series of slits are provided in the free end of the flap so as to provide the flap with a number of distinct straps 26. In order to manoeuvre the seaming aid it is necessary to simultaneously apply downward and lateral pressure. Thus this seaming aid is very difficult to handle.

The present invention seeks to provide a temporary seaming aid which is easy to handle when in use.

According to a first aspect of the present invention there is provided a temporary seaming aid for use in seaming a dryer fabric, the dryer fabric having at each fabric end a respective row of interdigitatable formations capable of union by a pintle wire to form a flexible joint, a respective one of complementary parts of said temporary seaming aid being provided adjacent to the said fabric ends, said parts being adapted for cooperation, in a relative disposition of the fabric ends consistent with engagement of the interdigitating formations, to maintain such interdigitation, wherein at least one of the complementary parts of the seaming aid comprises a looped handle.

According to a second aspect of the present invention there is provided a papermakers dryer fabric having, at each fabric end, a respective row of interdigitatable formations capable of union by a pintle wire to form a flexible joint and further including adjacent to the said fabric ends, a respective one of the complementary parts of a temporary seaming aid adapted for cooperation, in a relative disposition of the fabric ends consistent with engagement of the interdigitating formations, to maintain such interdigitation, wherein at least one of the complementary parts of the seaming aid comprises a looped handle.

The handles facilitate relatively east manoeuvrability of the fabric ends in order to ensure accurate interdigitation of the loops provided at the fabric ends. Preferably both of the complementary parts of the seaming aid have at least one looped handle. The connecting looped handles preferably comprise complementary surface grip material, such as a hook and pile fastener material.

The seaming aid preferably comprises an elongate structure, such as a length of webbing, on which are captured a plurality of straps defining said handles. The straps are preferably initially movable along the elongate structure. Once in the desired position the straps may be secured to the elongate structure. The straps preferably have a double looped structure, one loop of which is captured on the elongate structure.

According to a third aspect of the present invention there is provided a temporary seaming aid for use in seaming a dryer fabric, the dryer fabric having at each fabric end a respective row of interdigitatable formations capable of union by a pintle wire to form a flexible joint, a respective one of complementary parts of said temporary seaming aid being provided adjacent to the said fabric ends, said parts being adapted for cooperation, in a relative disposition of the fabric ends consistent with engagement of the interdigitating formations, to maintain such interdigitation, wherein at least one of the complementary parts of the seaming aid comprises a kit of parts including an elongate member and a plurality of straps, the straps being captured on the elongate member so as to be movable therealong such that the straps may be located at the desired position along the length of the elongate member, the straps being fixable in position by fixing apparatus once in the desired position. The fixing apparatus is usually of a temporary nature. Preferably the fixing apparatus comprises staples or stitching.

The complementary parts of the seaming aid are preferably each secured to the relevant end of the fabric by attaching the parts of the seaming aid to a monofilament wire on the opposing face of the fabric by stitching, preferably using a tack stitch. Once the seaming is complete the tack stitching may be broken at one end of the fabric and the monofilament removed allowing the seaming aid part to be removed as a single entity. Thus the seaming aid may be removed from the fabric with much less effort than the seaming means illustrated in FIGS. 1 or 2.

Seaming aids may be provided on both faces of the fabric. In such cases the elongate structures are ideally vertically aligned such that no extra stitching is required. This minimises damage to the fabric, The straps are also preferably vertically aligned.

In order that the present invention may be more readily understood a specific embodiment thereof will now be described by way of example only with reference to the accompanying drawings in which.

Figure 6:
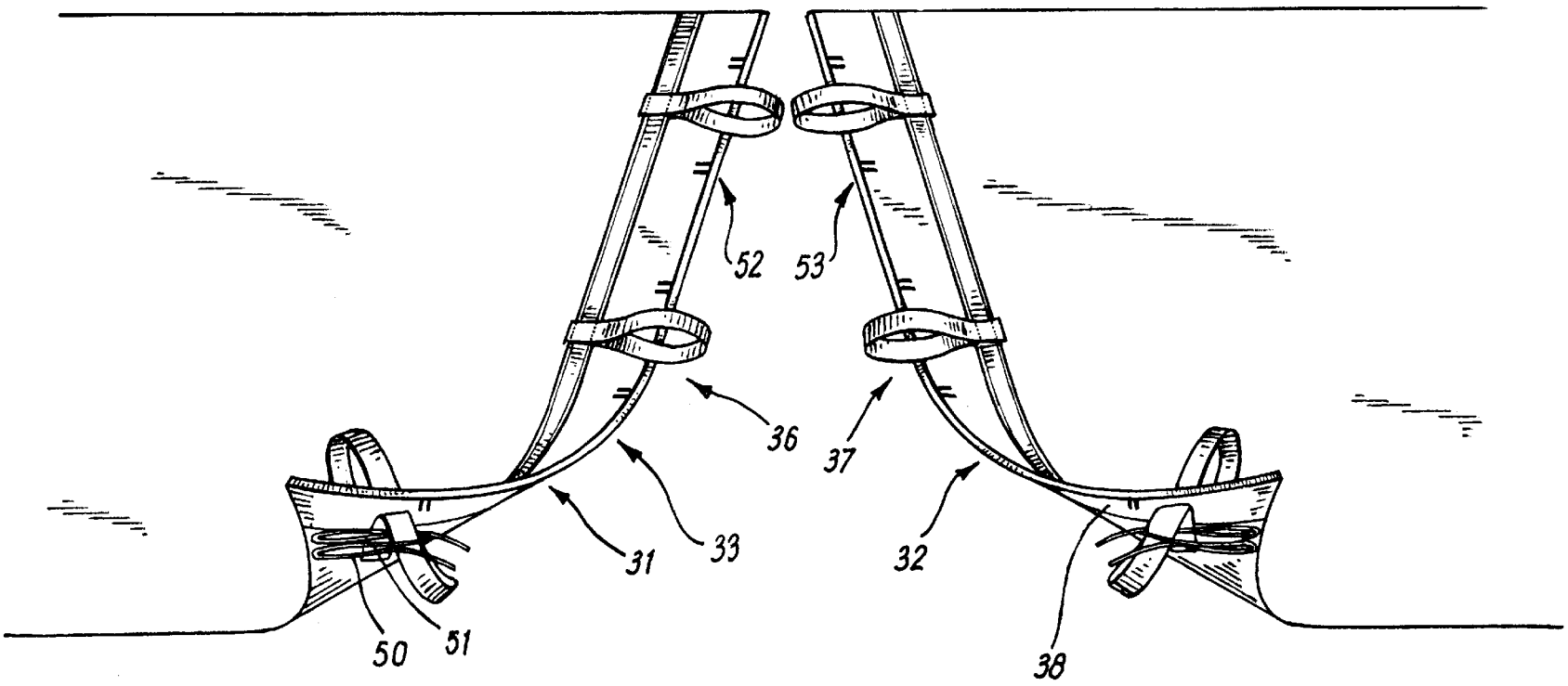
Figure 7:
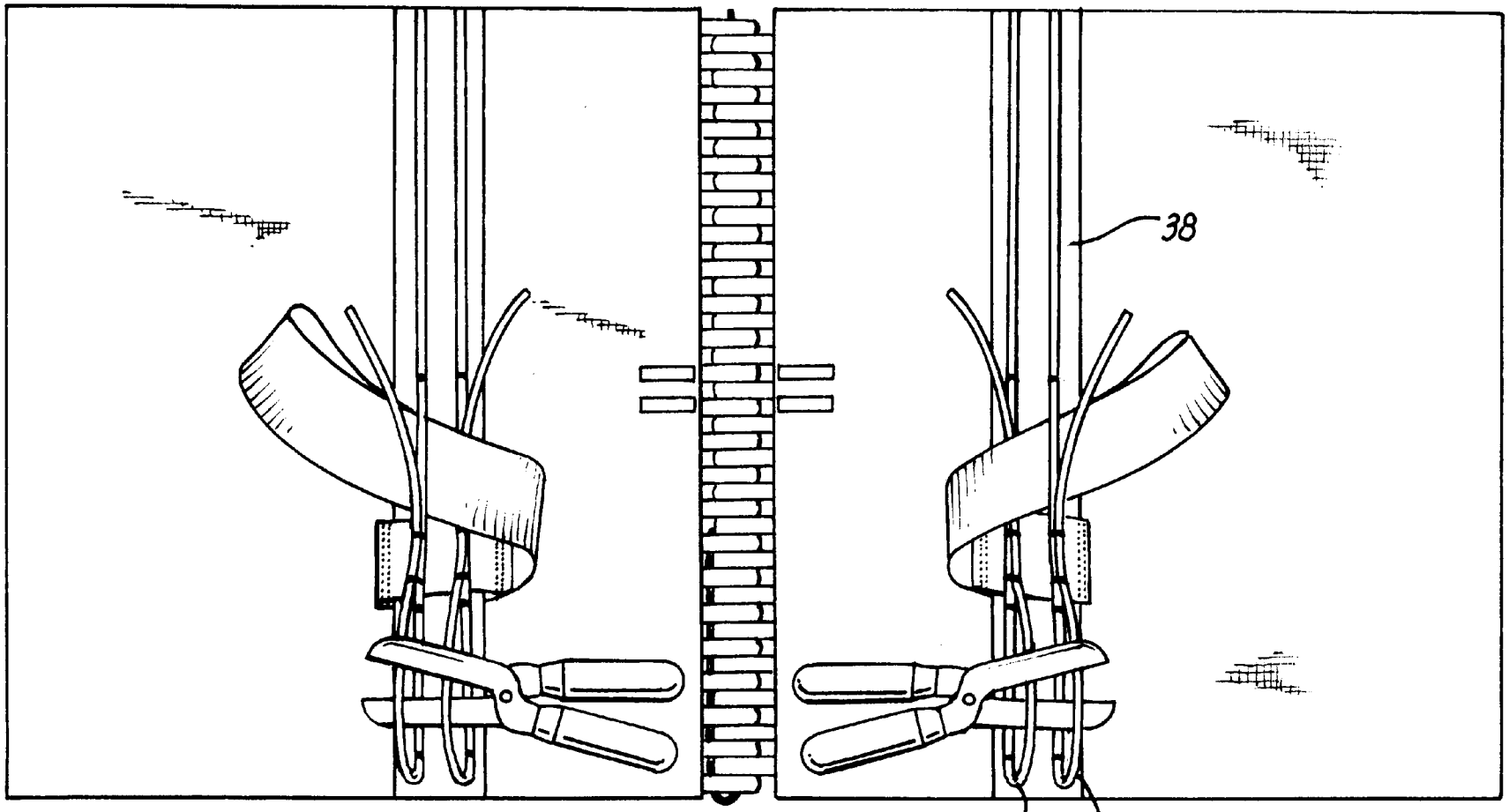

FIG. 6 is a perspective view of a dryer fabric temporary seaming arrangement in accordance with the present invention, showing the seaming arrangement provided on both sides of the fabric; and FIG. 7 is a perspective view of a portion of the nonpaper-contacting face of the fabric showing cutting of the monofilament wire causing removal of the entire webbing/loop assembly from the fabric as a single entity.

Figure 1:
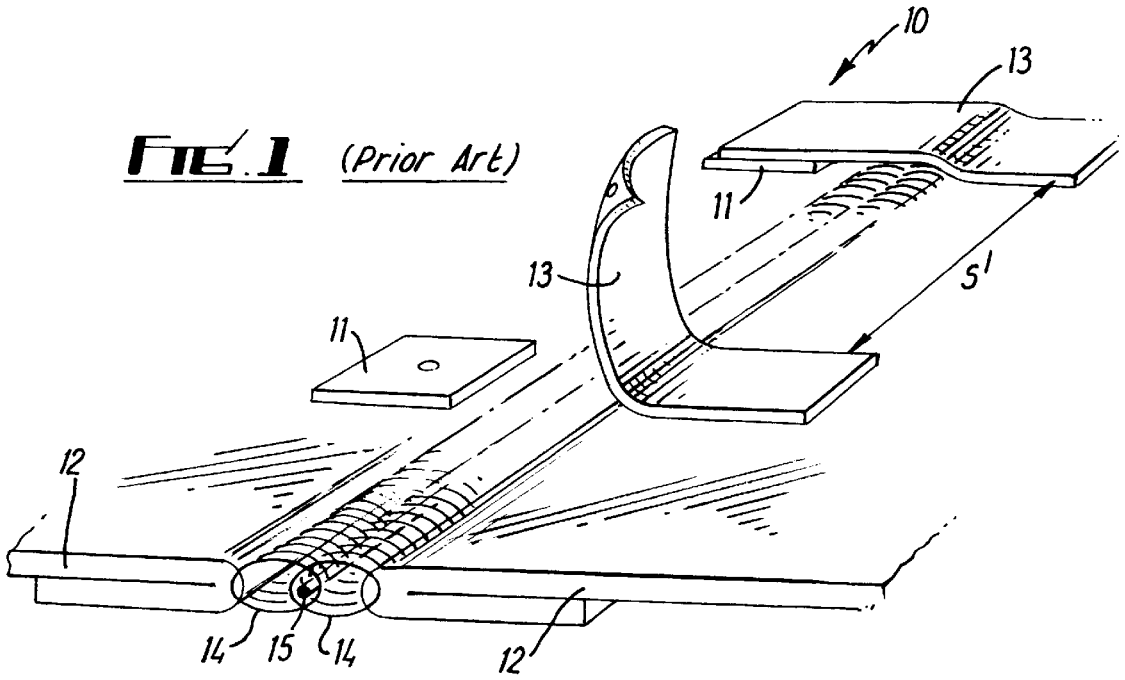
FIG. 1 (Prior Art)
FIG. 1 is a perspective view of a first prior art system for joining the two ends of a dryer fabric.
Figure 2:
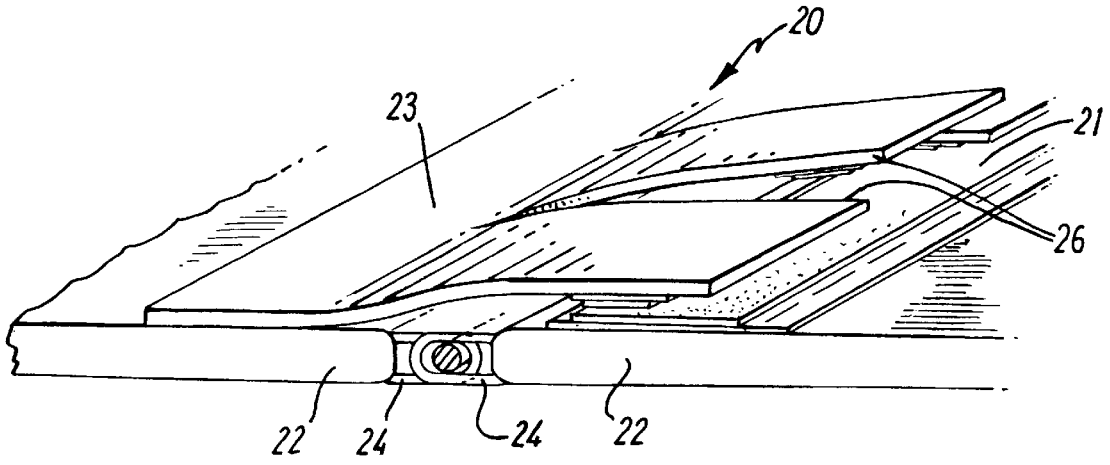
FIG. 2 (Prior Art)
FIG. 2 is a perspective view of a second prior art system for joining the two ends of a dryer fabric.

The prior art of FIGS. 1 and 2 has been discussed in detail in the introductory paragraphs hereof and will not be discussed further here.

Figure 3:
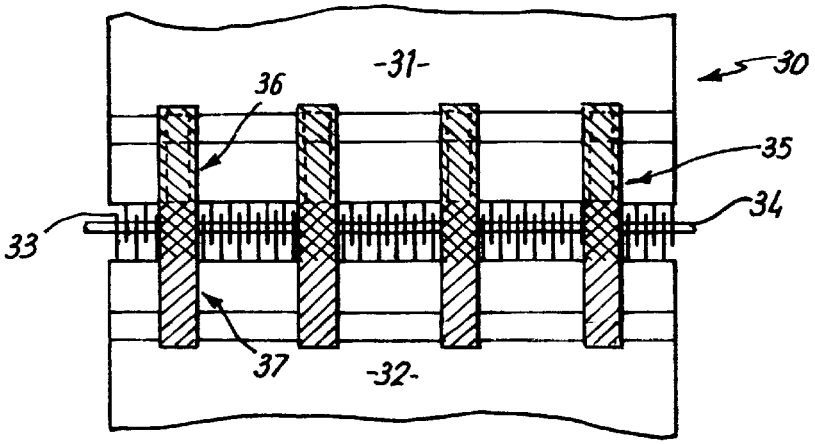
FIG. 3 is a plan view of a dryer fabric temporary seaming arrangement in accordance with the present invention.
Figure 4:
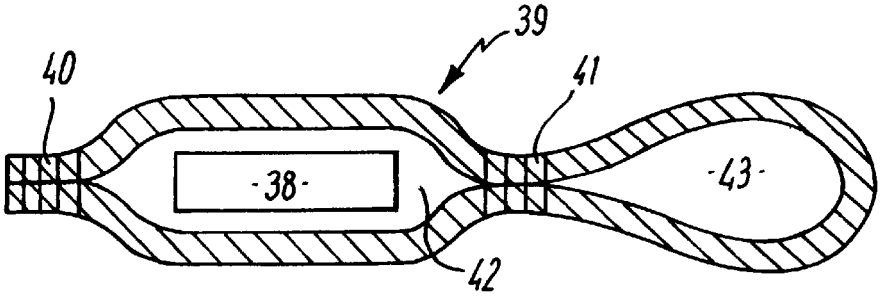
FIG. 4 is a side elevation of a temporary seaming aid in accordance with the present invention.

Referring to FIGS. 3 and 4 two ends 31,32 of a dryer fabric 30 have been brought together so as to interdigitate the loops 33 provided at the two ends 31,32 of the fabric 30 and so provide a tunnel for receiving a pintle wire 34. Once interdigitated a temporary seaming aid 35 is used to maintain the loops in an interdigitated state so as to ensure that the tunnel is not blocked thus preventing the passage of the pintle wire therethrough.

The temporary seaming aid comprises two similar structures 36,37, one of each being provided close to each end of the fabric. Each seaming structure 36,37 comprises a length of webbing 38 and a plurality of looped seaming straps 39. One such strap 39 is illustrated in FIG. 4. Each strap 39 comprises a length of material that is looped at one end. Two spaced apart rows of stitching 40,41 are used to sew the two layers of material together. This produces a strap defining a channel 42 and a loop 43. The channel is of sufficient dimensions to receive the webbing therethrough. The loop is of sufficient dimensions to be readily gripped by an operator's hand.

The straps 39 of the two seaming structures comprise complementary surface-grip material (such as a hook and pile fastener). VELCRO (trade mark) is a suitable material.

The temporary seaming aid 35 of the present invention is applied to the fabric in the manner set out below.

The two opposing ends 31,32 of the dryer fabric are marked across their widths at regular intervals to indicate the positioning of the straps 39.

A strip of webbing 38 is inserted through the channels of number of straps 39 corresponding to the number of marks and then a webbing38/strap assembly 36,37 is placed near each fabric end 31,32 running across the width of the fabric, and the straps 39 are moved along the webbing 38 so that they are positioned at the marked intervals.

The straps 39 are subsequently temporarily secured to the webbing 38 by, for example, stapling or using sticky tape, and then each strap 39 is stitched to the webbing 38, preferably along each longitudinal edge, with the end straps 39 at each extremity of the fabric width being stitched through the webbing 38 and into the dryer fabric 30.

Tack stitching is then used to loosely fasten the webbing/strap assembly 36,37 to a monofilament wire on the opposing face of the fabric 30.

Once the two fabric ends 31,32 have been joined together on the paper machine by means of the pintle wire 34 inserted into the interdigitated loops 33, the tack stitching is broken at one end of the fabric 30 and the monofilament is pulled out, causing the entire webbing/loop assembly 36,37 to be removed from the fabric as a single entity This is shown in FIG. 7.

Figure 5:
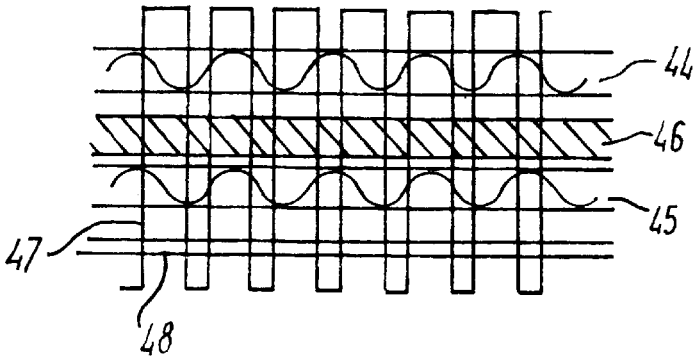
FIG. 5 is a diagrammatic view of a further dryer fabric temporary seaming arrangement in accordance with the present invention, showing the stitching for securing the temporary seaming aids to the fabric.

FIG. 5 shows a diagrammatic illustration of a further dryer fabric seaming arrangement in accordance with the present invention. The arrangement is similar to that described with reference to FIG. 3 except in that webbing/strap assemblies 44,45 are provided on both faces of a dryer fabric 46. Here tack stitching 47 passes down through the upper webbing/strap assembly 44,45, through the dryer fabric, through the lower webbing/strap assembly and around a monofilament wire 48 and back up again before subsequent repeats. It is noted that the upper and lower lengths of webbing and the straps located on the two lengths of webbing are vertically aligned.

FIG. 6 shows the two fabric ends 31,32 prior to joining with the seaming aid. The webbing 38/strap assembly 36,37 is provided on both sides of the fabric. In this embodiment of the invention there are two monofilament wires 50,51 on the non-contacting face of the fabric. The seaming structures 36,37 on the paper-contacting side of the fabric are complementary surface grip material. The seaming structures on the opposing side of the fabric are usually tucked away from the seam region during seaming. Series of opposing check marks 52,53 placed on the seam region are used to align the two edges of the fabric to ensure the loops of the complementary interdigitating formations 33 are aligned so as to reduce friction on the pintle wire 34.

In use of one particular embodiment of the present invention, the check marks 52,53 are aligned by adjustment of the edges of the fabric through use of the seaming aid, the pintle wire 34 is passed through every loop or sprial 33 in the seam. This can be checked by opening the handles 39. The leader wire is then removed and the ends of the pintle wire are tucked back into the seam to avoid interference and damage. Adhesive is applied to each edge of the seam to hold the pintle wire in place. The monofilament wires 50,51 can then be cut on the non-paper contacting side of the fabric and pulled out to release the entire seaming aid.

It is to be understood that the above described embodiment is by way of illustration only. Many modifications and variations are possible.

We claim:

1. A temporary seaming aid for use in seaming a dryer fabric, the dryer fabric having at each fabric end (31, 32) a respective row of interdigitatable formations (33) capable of union by a pintle wire (34) to form a flexible joint, characterised in that a respective one of complementary parts (36, 37) of said temporary seaming aid is provided adjacent to each said fabric end, said parts (36, 37) being adapted for cooperation, in a relative disposition of the fabric ends (31, 32) consistent with engagement of the interdigitating formations (33), to maintain such interdigitation, wherein at least one of the complementary parts (36 or 37) of the seaming aid comprises a looped handle (43).

2. A temporary seaming aid according to claim 1, wherein both complementary parts (36, 37) of the seaming aid have at least one looped handle (43).

3. A temporary seaming aid according to claim 2, wherein the connecting looped handles (43) comprise complementary surface grip material.

4. A temporary seaming aid according to claim 3, wherein the surface grip material is a hook and pile fastener material.

5. A temporary seaming aid according to claim 3, wherein the seaming aid parts each comprise an elongate structure (36, 37) on which are captured a plurality of straps defining said handles (39).

6. A temporary seaming aid according to claim 5, wherein the elongate structure is a length of webbing (38).

7. A temporary seaming aid according to claim 6, wherein the straps (39) are initially movable along the elongate structure (38).

8. A temporary seaming aid according to claim 7, wherein the strap (39) is secured to the elongate structure webbing (38).

9. A temporary seaming aid according to claim 8, wherein each strap (39) has a double looped structure, one loop (42) of which is captured on the elongate structure.

10. A temporary seaming aid according to claim 1, wherein the complementary parts of the seaming aid (36, 37) are each secured to the relevant end (31 or 32) of the fabric by attaching the part of the seaming aid to a monofilament wire (48) on the opposing face of the fabric by stitching, preferably using a tack stitch.

11. A papermakers dryer fabric having, at each fabric end (31, 32), a respective row of interdigitatable formations (33) capable of union by a pintle wire (34) to form a flexible joint characterised in that it further includes at the said fabric ends (31, 32), a respective one of the complementary parts (36, 37) of a temporary seaming aid provided adjacent to the said fabric ends (31, 32), said parts being adapted for cooperation, in a relative disposition of the fabric ends consistent with engagement of the interdigitating formations (33), to maintain such interdigitation, wherein at least one of the complementary parts (36, 37) of the seaming aid comprises a looped handle (39).

12. A papermakers dryer fabric according to claim 11, wherein the papermakers dryer fabric is provided with a temporary seaming aid.

13. A temporary seaming aid for use in seaming a dryer fabric, the dryer fabric having at each fabric end (31, 32) a respective row of interdigitatable formations (33) capable of union to a pintle wire (34) to form a flexible joint, characterised in that a respective one of complementary parts of said temporary seaming aid is provided adjacent to the said fabric ends (31, 32), said parts (36, 37) being adapted for cooperation, in a relative disposition of the fabric ends (31, 32) consistent with engagement of the interdigitating formations (33), to maintain such interdigitation, at least one of the complementary parts of the seaming aid comprising a kit of parts including an elongate member (38) and a plurality of straps (39), the straps being captured on the elongate member so as to be movable therealong such that the straps (39) may be located at the desired position along the length of the elongate member, the straps (39) being fixable in position by fixing apparatus once in the desired position.

14. A temporary seaming aid according to claim 12, wherein the fixing apparatus comprises staples or stitching (40).

15. A method of using a temporary seaming aid in seaming a dryer fabric, the dryer fabric having at each fabric end (31, 32) a respective row of interdigitatable formations (33) capable of union by a pintle wire (34) to form a flexible joint, wherein complementary parts (36, 37) of said temporary seaming aid are adjusted in cooperation with each other so that the relative dispositions of the fabric ends are consistent with engagement of the interdigitating formations (33), allowing insertion of the pintle wire (34) resulting in seaming of the dryer fabric and at least one of the complementary parts (36, 37) of the seaming aid comprising a looped handle (39).

* * * * *